United States Patent [19]

Meehan

[11] Patent Number: 4,496,026

[45] Date of Patent: Jan. 29, 1985

[54] FOUNDING LADDER SYSTEM

[75] Inventor: Richard G. Meehan, Laguna Niguel, Calif.

[73] Assignee: Kwikform America, Inc., Fountain Valley, Calif.

[21] Appl. No.: 291,275

[22] Filed: Aug. 10, 1981

[51] Int. Cl.[3] ..... E04G 1/36; E04G 3/02

[52] U.S. Cl. ..... 182/128; 182/179

[58] Field of Search ..... 182/128, 45, 178, 179, 182/93, 104, 214, 121; 52/638

[56] References Cited

U.S. PATENT DOCUMENTS

| | | | |
|---|---|---|---|
| 681,649 | 8/1901 | Chase | 182/45 |
| 742,565 | 10/1903 | Berry | 182/45 |
| 1,090,856 | 3/1914 | Johnson | 182/128 |
| 1,652,403 | 12/1927 | Gerdeman | 182/128 |
| 2,848,282 | 8/1958 | Weber | 182/45 |
| 3,245,188 | 4/1966 | Evans | 52/638 |
| 4,342,374 | 8/1982 | Montana | 182/45 |

FOREIGN PATENT DOCUMENTS

| | | | |
|---|---|---|---|
| 217052 | 11/1956 | Australia | 182/214 |
| 248181 | 4/1970 | U.S.S.R. | 182/128 |
| 324362 | 2/1972 | U.S.S.R. | 182/128 |
| 838060 | 9/1979 | U.S.S.R. | 182/128 |

*Primary Examiner*—Reinaldo P. Machado

*Attorney, Agent, or Firm*—Knobbe, Martens, Olson & Bear

[57] ABSTRACT

A founding ladder system provides support for a scaffolding system mounted inside an enclosed area, such as a boiler. The founding ladder system is modular in construction to allow for easy use and is both adjustable and adaptable to fit the various sizes and shapes of boilers in which it may be used. The founding ladder system includes a truss which is to be mounted horizontally and which is to be connected to ladder-like supports which extend up the inside walls of the boiler. The ladder-like supports provide points of contact for the scaffolding system to be constructed inside the boiler.

32 Claims, 5 Drawing Figures

FOUNDING LADDER SYSTEM

FIELD OF THE INVENTION

This invention is generally related to the field of scaffolding and more particularly relates to the scaffolding supports for use inside boilers.

BACKGROUND OF THE INVENTION

Various types of boilers are used in different industries, such as steam boilers used for electrical power generation. The boilers may have large, enclosed, metal-lined tanks used for containing water or steam and generally include a converging pair of downwardly sloping lower boiler tank walls. In order to ensure the continued satisfactory performance of boilers, the tanks must be periodically maintained, repaired, and internally cleaned. As a part of the procedure for maintenance, repair or cleaning, it is necessary for workmen to enter inside the boiler tank and work on the inside walls of the boiler. Scaffolding systems having platforms arranged in vertical levels are placed inside a boiler being maintained or cleaned so that workmen are provided with suitable platforms to stand on while working on the inside walls of the boiler. The platforms also provide a location for the placement of tools used in the work performed inside the boiler.

One previous approach used to support scaffolding inside a boiler included scaffolding support bars which were temporarily welded directly onto the lower boiler sidewalls. Scaffolding was then erected inside the boiler with support provided by vertical posts which would rest on the support bars and thus would transfer the weight of the scaffolding directly to the lower boiler sidewalls through weldments. This prior approach was not entirely satisfactory in that the welding was time-consuming and the scaffolding support bars had to be precisely arranged on the lower boiler sidewalls in order to properly support the vertical posts. Also, the locations of the support bars had to be precisely measured and laid out so that the vertical posts of the scaffolding would be properly supported. In this prior approach, after the cleaning or maintenance was completed, the weldments would be broken and the scaffolding support bars would be removed from the boiler sidewalls. The breaking and removing of weldments could damage the boiler walls.

Many and various types of scaffolding systems may be used to support work platforms inside a boiler. One type of scaffolding system is shown by H. S. Evans in U.S. Pat. No. 3,245,188 which shows the use of prefabricated members which can be easily fitted together to provide scaffold structures having a variety of base plans of differing sizes and which are braced at all the joints. In particular, FIG. 11 of that patent shows an adjustable post which may be used in scaffold structures. Similarly, adjustable struts for use in a scaffolding structure are shown by T. I. Gostling in U.S. Pat. No. 3,366,361. The disclosures of the two above-mentioned patents are incorporated herein by reference.

SUMMARY OF THE INVENTION

This invention involves an assembly of structures for supporting scaffolding inside a boiler. A founding truss is provided for horizontally spanning between the boiler walls and for transferring forces from the scaffolding to the boiler walls. Sidewall supports are provided for mounting on each end of the founding truss and are designed to extend above and along the boiler walls in order to provide support points for scaffolding above the sidewall supports.

A significant feature of this invention is that the use of a founding truss and sidewall supports as described in this invention allows scaffolding to be conveniently and quickly placed inside a boiler and removed from inside the boiler.

Another important feature of this invention is that no weldments need be attached to the insides of the boiler walls, thus preventing damage to the boiler walls, saving time, and obviating the need for precise layout measurements to be made on the inside of the boiler each time that scaffolding is to be erected therein.

Another feature of this invention is that the structures described are capable of use with a variety of differently sized boilers having different internal configuration shapes.

A further feature of this invention is that the structures used are modular in nature so that a relatively few different types of structures need be manufactured and elaborate scaffolding supports can be assembled as collections of these modular structures. Thus, the logistics of manufacturing, stocking, and distributing the scaffolding support assembly described herein is simplified by the modular nature of the structures comprising the assembly.

Another feature of the instant invention is the fact that the founding truss used provides vertical support to the scaffolding system over the central region of the internal boiler cavity.

Another feature of this invention is that the assembly may be disassembled into separate structures and each of the structures comprising the overall scaffolding support assembly is sized so as to be capable of passing through a reletively small aperture, such as the access door to a boiler. That is, the founding truss and sidewall founding supports are each narrow, elongated structures. The specific method of interconnecting and mounting the structures disclosed in this invention is especially adapted so that the physical size for the structure components is limited. The size limitations are important so that the scaffolding support assembly can enjoy wide use among the various existing boilers.

DESCRIPTION OF THE PREFERRED EMBODIMENT

Figure 1:
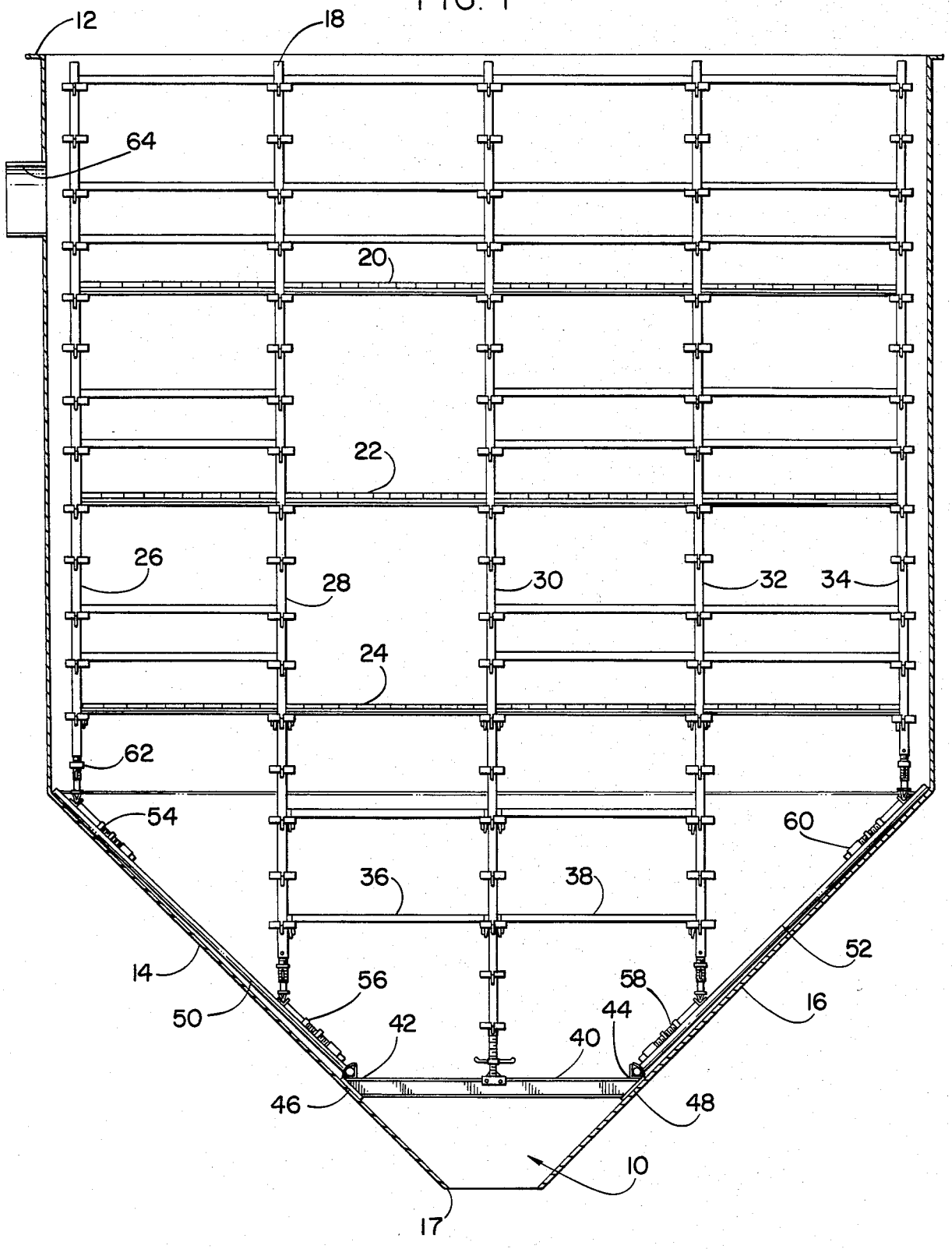
FIG. 1 is a partly cut-away, side elevational view of a boiler, a scaffolding system mounted inside the boiler, and the scaffolding support assembly of this invention.

Referring first to FIG. 1, scaffolding support assembly 10 is a founding ladder system which fits inside boiler 12 and rests against lower boiler walls 14 and 16. Boiler 12 is a generally rectangular fire box lined with tubes (water walls) which carry water or steam and are shown in the drawings as walls 14 and 16. Water walls 14 and 16 are generally planar and slope downwardly to converge toward a central opening slot 17 in the bottom of boiler 12.

Scaffolding support assembly 10 functions to provide vertical support to a scaffolding system 18 assembled inside boiler 12. The function of scaffolding system 18 is to allow workmen to repair and clean the inside walls of boiler 12, while providing the workmen with a platform on which to stand or place their tools while working.

Scaffolding system 18 is a modular assembly of individual parts which are commercially available and which are linked and attached together in a known way to create a series of platforms 20, 22, and 24 which are horizontal surfaces spaced apart vertically to provide surfaces on which workmen may walk to stand when inside boiler 12. The platforms 20, 22, and 24 are supported by the vertical uprights 26, 28, 30, 32, and 34 which are parts of the system 18 spaced apart along the width of boiler 12 and which are elongated, segmented posts for transfering weight and forces from the platforms 20, 22, and 24 to the scaffolding support assembly 10.

In practice, scaffolding system 18 includes a plurality of vertical uprights spaced apart along the length of boiler 12 to be parallel to and aligned with uprights 26, 28, 30, 32, and 34. A plurality of scaffolding support assemblies identical in construction to assembly 10 are spaced apart along the length of boiler 12 to support the vertical uprights and scaffolding system 18. Thus scaffolding system 18 is a three-dimensional latticework including vertical uprights to support horizontal platforms.

The vertical uprights, of which uprights 28, 30, and 32 are typical, are separated horizontally by a plurality of horizontal links, of which links 36 and 38 are typical, which are connected between pairs of the uprights and which extend across the width and along the length of boiler 12.

Support assembly 10 has founding truss 40 which is shaped like a steel "I" beam extending horizontally between the lower boiler sidewalls 14 and 16. The founding truss 40 is an elongated beam having a left end 42 and a right end 44, having sidewall supports 46 and 48, respectively, mounted thereon. The sidewall supports 46 and 48 are wedged in place resting against the sidewalls 14 and 16, respectively.

As shown in the embodiment of FIG. 1, the sidewall supports 46 and 48 are plates securely attached to founding truss 40. The sidewall supports 46 and 48 are mounted at appropriate angles to the truss 40 so that the truss 40 wedges between the sidewalls 14 and 16, the supports 46 and 48 conform closely to the shape of the sidewalls 14 and 16, respectively, and the truss 40 is maintained in a substantially horizontal position inside the boiler 12. The purpose of the supports 46 and 48 is to transfer forces from the scaffolding system 18 which pass through the founding truss 40 and to the sidewalls 14 and 16.

The supports 46 and 48 are preferably steel plates which are securely welded to the truss 40 which also is preferably composed of steel. The supports 46 and 48 may also have plywood facing pads (see FIG. 2) for contacting the sidewalls 14 and 16, respectively. The purpose of placing plywood facing pads on the supports 46 and 48 is to provide secure gripping of the sidewalls by the supports, to allow the supports to conform to any surface imperfections in the sidewalls, and to provide for shock absorption between the supports and the sidewalls.

The founding supports 50 and 52 extend upwards from the truss 40 along the sidewalls 14 and 16, respectively. The founding supports 50 and 52 are substantially identical in construction and preferably each consists of a ladder having a pair of tubular uprights connected by a plurality of spaced-apart rungs. The purpose of the founding supports 50 and 52 is to provide support for vertical posts extending downwards from the scaffolding system 18.

The founding brackets 54 and 56 are placed on the founding support 50 and are substantially identical in construction. The founding brackets 58 and 60 are placed on the founding support 52 and are substantially identical in construction to the founding brackets 54 and 56. The function of the founding brackets 54, 56, 58, and 60 is to provide adjustable points of support for the scaffolding system 18 on the founding supports 50 and 52. For example, the founding bracket 54 adjusts laterally in length along the founding support 50 in order to provide support for the vertical post 26 of the scaffolding system 18. The vertical post 26 is similar in construction to the vertical posts 28, 32, and 34, and includes an adjustable section 62, the length of which is vertically adjustable in order to level the scaffolding system 18 and in order to properly contact the founding bracket 54. Therefore, the founding bracket 54 is slidably adjustable along the length of the founding support 50 in order to reach a proper horizontal position to meet with the post 26. The post 26 is vertically adjustable (by means of section 62) in order to properly meet with the founding bracket 54. The function of the founding bracket 54 is to provide vertical support for the post 26 and to transfer forces from the post 26 to the founding support 50. The forces transferred through the founding bracket 54 are transferred to the sidewall 14 through the founding support 50 and the founding truss 40. The post 30 similarly includes an adjustable section which rests on the truss 40 in order to adjust the vertical position of the scaffolding system 18.

An accessway door 64 is provided in the side of the boiler 12 in order to allow workmen and their equipment to move inside the boiler 12. The access doorway 64 is normally made of a very small size because of the high temperatures and pressures which must be contained inside the boiler 12. The accessway 64 is normally of a size just large enough to comfortably allow a workman to enter into and leave from the inside of the boiler 12. Since the size of the accessway 64 is limited, it is necessary that each of the parts of the scaffolding assembly 18 and the scaffolding support assembly 10 be small enough to fit easily through the accessway 64 each time that cleaning or repair operations are to be performed inside the boiler 12. Therefore, the scaffolding assembly 18 is of modular construction which may be assembled and disassembled inside the boiler 12. Similarly, the scaffolding support assembly 10 of this invention is of a modular construction which may be disassembled and assembled inside the boiler 12. The founding supports 50 and 52 may be coupled and uncoupled from the founding truss 40 so that the founding truss 40, and the supports 50 and 52 may be easily passed through the accessway 64. The founding supports 50 and 52 are preferably each assembled as lengths of ladder coupled together so that the length of the scaffold supports 50 and 52 may each be adjusted to accommodate the particular boiler 12 used and to allow each of the scaffolding supports 50 and 52 to be disassembled into shortened lengths when passing through the accessway 64. The founding brackets 54, 56, 58, and 60 may be removed from the founding supports 50 and 52 when transfer through the accessway 64 is required. The modular nature of the founding support system 10 is an advantage not only in allowing easy passage through the accessway 64 of the boiler 12, but also is an advantage in that the system 10 may be expanded to fit various different size boilers by including the particular length of founding supports 50 and 52 required, and the particular numbers of founding brackets required. The modular nature of the founding support system 10 also allows the commercial supplier of scaffolding products to stock a limited variety of component parts which may be assembled into the many various arrangements required by users.

In practice, workmen will pass the founding truss 40 through the accessway 64 first in order to form a brace for the scaffolding system 18. The workmen will then pass through the accessway 64 the components required to construct the scaffold supports 50 and 52 and then will attach those components together and connect the scaffold supports 50 and 52 to the founding truss 40. Since a plurality of founding trusses identical to the truss 40 will normally be arranged in a parallel sequence along the length of the boiler 12, the workmen will construct a founding support system 10 consisting of a large number of founding trusses, founding supports, and founding brackets before beginning the construction of the scaffolding system 18 inside the boiler 12.

After the maintenance or cleaning operation has been completed inside the boiler 12, the workmen will disassemble the scaffolding system 18 and pass its component parts through the accessway 64. After the scaffolding system 18 has been removed, the component parts of the scaffolding support system 10 will be disassembled inside the boiler 12 and removed through the accessway 64.

Figures 2, 3:
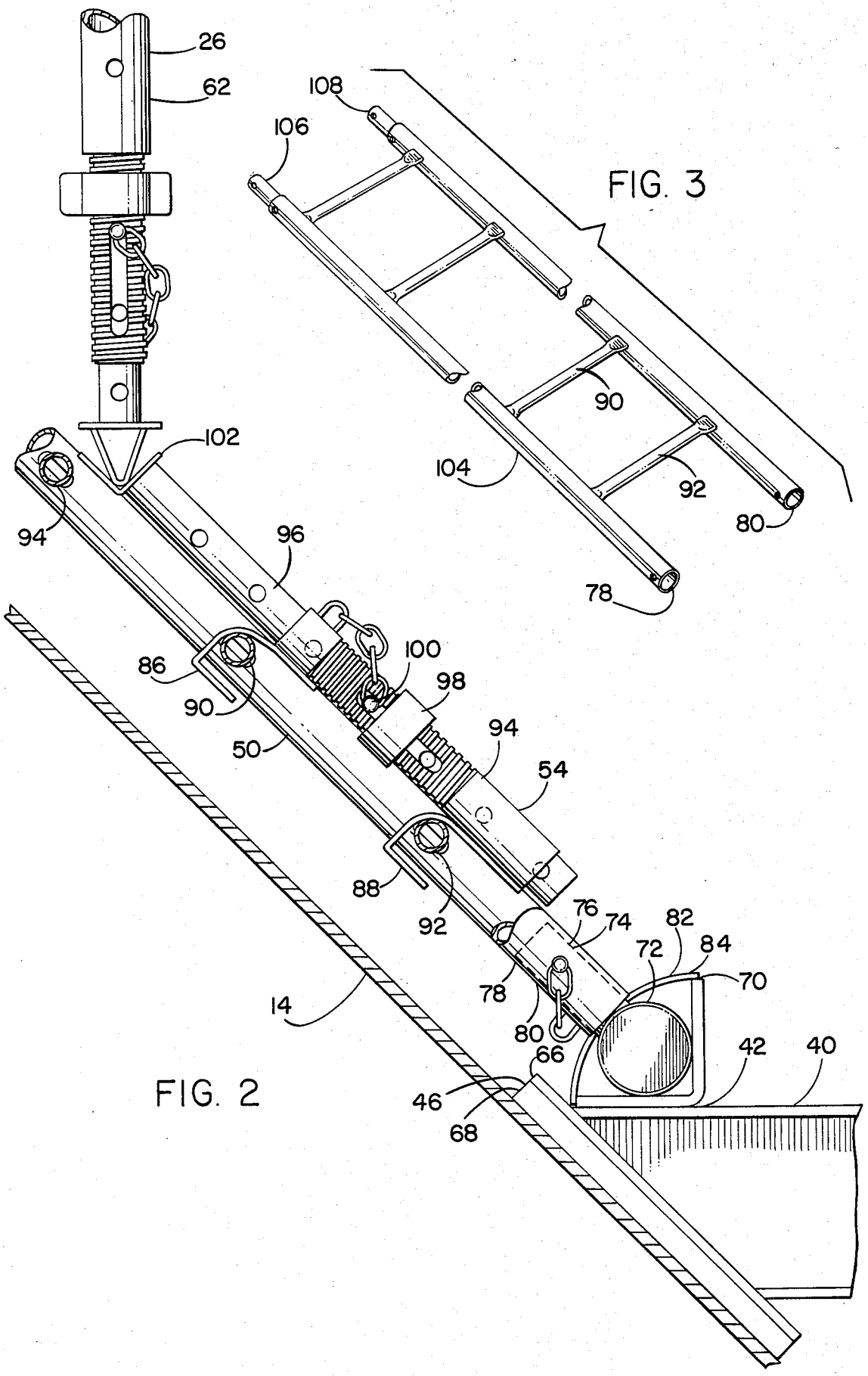
FIG. 2 is a partially cut-away, side elevational view of a portion of the boiler, scaffolding system, and scaffolding support assembly shown in FIG. 1.
FIG. 3 is a perspective view of a sidewall support.

Referring next to FIG. 2, the support 46 includes a flat steel plate 66 welded to the "I" beam truss 40. The pad 68 is securely attached to the plate 66 and preferably is a sheet of plywood. The pad 68 is positioned between the plate 66 and the boiler sidewall 14. The plate 66 is positioned on the truss 40 so that the pad 68 makes intimate contact with the boiler sidewall 14. The function of the pad 68 is to conform to any irregularities in the sidewall 14 and to remain in place on the boiler sidewall 14 by friction contact with the sidewall 14.

As an alternative embodiment (not shown in the drawings), the sidewall supports 46 and 48 may be rotatably mounted or pivotably on the truss 40 so that the support plates 46 and 48 are allowed to automatically conform to the slope of the lower boiler walls 14 and 16. Such a construction is of particular advantage to minimize the different types of trusses required for the various boilers in use. If the plates 46 and 48 are not allowed to automatically conform to the shape of the sidewalls 14 and 16, then the truss 40 may only be used with boilers having sidewalls at angles exactly matching those of the plates 46 and 48. The alternative embodiment of pivotably mounting the support plates 46 and 48 on the truss 40 allows the truss 40 to be used with various boilers having various differing sidewall angles. The support plates 46 and 48 may be pivotably connected to the truss 40 by a hinge construction in which hinge plates are welded to project from each of the support plates 46 and 48, and in which hinge pins project horizontally through the hinge plates and the truss 40 so that the support plates 46 and 48 may pivot vertically on the ends 42 and 44 of the truss 40.

A mounting hinge 70 is mounted on the upper surface of the end 42 of the truss 40. The function of the hinge 70 is to pivotably connect the founding support 50 to the truss 40. The hinge 70 includes an elongated hinge rod 72 having stub connectors 74 and 76 projecting therefrom (with connector 76 shown behind connector 74 in FIG. 2). The function of the rod 72 is to rotate inside the hinge 70 to provide the hingeing action. The function of the connectors 74 and 76 is to fit inside the hollow tubular uprights 78 and 80, respectively (with upright 80 shown behind upright 78 in FIG. 2). In use, the connectors 74 and 76 may be inserted into, or pulled out of, the hollow uprights 78 and 80 so that the founding support 50 may be connected to or disconnected from the truss 40.

A function of the hinge 70 is to hold the founding support 50 in place so that the founding support 50 may pivot to conform to the angle of the boiler sidewall 14, and to prevent the founding support 50 from moving downwards along the sidewall 14 or from sliding across the length of the truss 40. The hinge 70 also provides for a transfer of forces between the founding support 50 and the truss 40 so that the scaffolding system 18 is supported.

The strap retainers 82 and 84 are part of the hinge 70 and encircle the hinge rod 72. The function of the strap retainers 82 and 84 is to hold the hinge 70 together and prevent the hinge rod 72 from sliding out of the hinge 70. The hinge 70 is preferably constructed as a steel angle iron having the hinge rod 72 mounted inside the angle with the strap retainers 82 and 84 welded in place over the mouth of the angle iron in order to trap the rod 72.

The founding bracket 54 includes rung gripping hooks 86 and 88 which fit over and engage the rungs 90 and 92 of the founding support 50. In the ladder-like construction of the founding support 50, the rungs 90 and 92 extend between the uprights 78 and 80. The function of the hooks 86 and 88 is to transfer forces between the founding bracket 54 and the founding support 50 and also to hold the founding bracket 54 in place on the founding support 50.

The founding bracket 54 preferably includes a threaded tubular body 94 having an extensible section 96 passing through the center thereof. A threaded collar 98 is mounted around and threaded on the tubular section 94 and serves to adjust the amount of extension of the section 96 by adjusting the position of a pin 100 which passes through a slot in the section 94 and a hole in the section 96. In practice, the degree of extension of the section 96 is adjusted by placing the pin 100 in a desired hole in the section 96 and by rotating the collar 98 to adjust the position of the pin 100 relative to the section 94.

The post receiving channel 102 is preferably constructed of a steel angle iron securely attached to the upper end of the extensible section 96. The function of the post receiving channel 102 is to provide a support point for the vertical upright post 26 of the scaffolding system 18. In use, the pin 100 and collar 98 are adjusted so that the channel 102 is positioned directly vertically underneath the post 26. If sufficient adjustment is not available through the use of the pin 100 and collar 98, the founding bracket 54 may be repositioned so that the hook 86 engages the rung 94 of the founding support 50 and so that the hook 88 engages the rung 90. Thus the position of the channel 102 along the length of the founding support 50 may be adjusted by changing the position of the hooks 86 and 88, and by adjusting the pin 100 and collar 98.

The adjustable section 62 of the post 26 may be adjusted in cooperation with the adjustments made to the founding bracket 54 so that the post 26 properly fits into the channel 102.

Referring next to FIG. 3, the ladder-like construction of the founding support 50 is shown. The founding support 50 preferably is constructed from a plurality of sections identical to the section 104 shown in which the sections are held together by pins 106 and 108 which fit inside the hollow uprights 78 and 80. It is preferable that the founding support 50 break down (disassemble) into sections identical to section 96 in order that the founding support 50 may easily pass through the accessway 64 of the boiler 12. The use of ladder sections identical to section 104 allows founding supports of various lengths to be built up in order to accommodate various boiler sizes and configurations.

Figure 4:
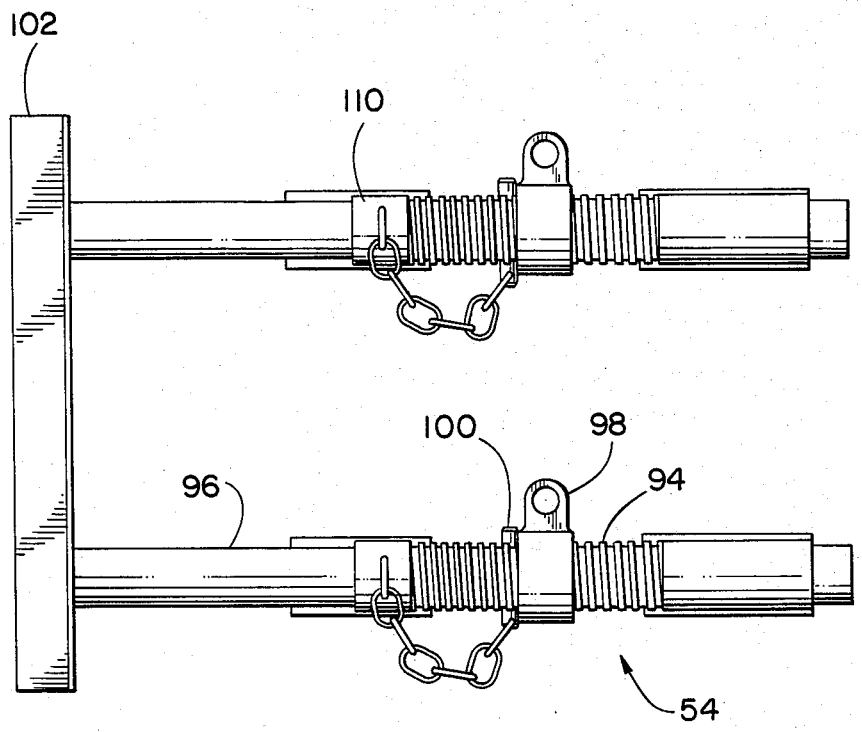
FIG. 4 is a top, plan view of a post support bracket.

Referring next to FIG. 4, the tubular body member 94 and the extensible section member 96 together form a strut which is parallel to a substantially identical strut 110 which is also connected to the channel or through 102. The strut 110 also clips over the parallel, spaced-apart support rungs 90 and 92 of the founding support 50 so that the strut 110 also holds the channel 102 in place. In use, the length of the strut 110 is adjusted in the same way as adjustments to the pin 100 and collar 98, so that the channel 102 remains substantially horizontal. The strut 110 cooperates with the strut formed by the body 94 and the section 96 to support a scaffolding post resting in the channel 102.

Figure 5:
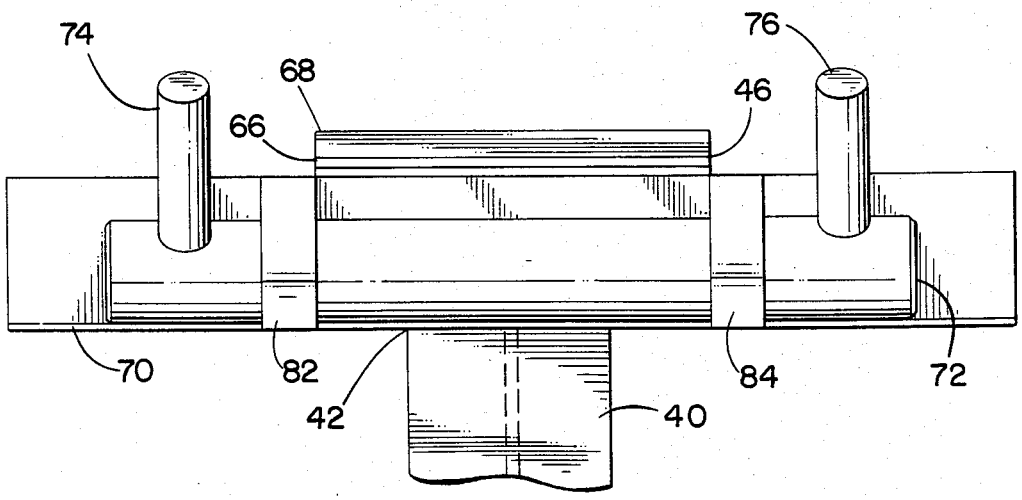
FIG. 5 is a top, plan view of a portion of a founding truss.

Referring next to FIG. 5, the retainer straps 82 and 84 are preferably positioned between the rod or stub connectors 74 and 76 so that the hinge rod 72 is trapped inside the hinge 70 and is prevented from falling away from the truss 40.

What is claimed is:

1. A readily assemblable system for supporting scaffolding inside a boiler having a converging pair of downwardly sloping lower boiling walls, said assemblable system capable of use with a variety of different size boilers having different internal configurations, wherein said system comprises:

a generally horizontal founding truss for spanning between said lower boiler walls; and a pair of sidewall supports mounted on opposite ends of said founding truss for extending upwardly from said truss and along the lower boiler sidewalls, said sidewall supports contacting said boiler sidewalls, transferring a portion of the weight of said scaffolding to said downwardly sloping boiler walls; and detachable post support means adapted for positioning at any of a plurality of locations along the length of said sidewall supports, said support means adapted to connect said scaffolding to said sidewall supports.

2. A system as recited in claim 1 wherein said founding truss is positioned wholly within said lower boiler walls.

3. A system as recited in claim 1 wherein said truss includes means for bracing said founding truss against said lower boiler walls without attachment thereto.

4. The system as recited in claim 1 further comprising:

at least one post receiving surface connected to said detachable post support means and adapted to engage a first vertical support post; and means for adjusting the position of said post receiving surface relative to said first vertical support post to effect secure contact between the post receiving surface and said first vertical support post.

5. The system as recited in claim 4 wherein said adjusting means comprises a length adjusting section forming a portion of said first vertical support post and adapted to vary the length of said first vertical support post.

6. The system as recited in claim 4 wherein said adjusting means comprises an extendable section forming a portion of said post support means, and adapted to move said post receiving surface relative to said sidewall supports.

7. The system as recited in claim 1 further comprising adjustable receiving means for engaging said post support means to said scaffolding.

8. A readily assemblable system for supporting scaffolding inside a boiler capable of use with a variety of different size boilers having different internal configurations, wherein the boiler includes a converging pair of downwardly sloping lower boiler walls, said system comprising:

a generally horizontal founding truss for spanning between said lower boiler walls;

a pair of sidewall supports mounted on opposite ends of said founding truss for extending above and along said lower boiler sidewalls, and for supporting said scaffolding;

a pair of means for pivotably mounting said sidewall supports on said founding truss so that said sidewall supports conform to the slope of said lower boiler sidewalls; and detachable post support means adapted for positioning at any of a plurality of locations along the length of said sidewall supports, said support means adapted to engage a first vertical support post, said vertical support post being interconnectable with additional vertical support posts adapted to support horizontal platforms.

9. The assembly of claim 8 wherein said pair of pivotable mounting means further allows said sidewall supports to be replaceably uncoupled from said founding truss.

10. The system as recited in claim 8 further comprising:

at least one post receiving surface connected to said detachable post support means and adapted to engage said first vertical support post; and means for adjusting the position of said post receiving surface relative to said first vertical support post to effect secure contact between the post receiving surface and said first vertical support post.

11. The system as recited in claim 10 wherein said adjusting means comprises a length adjusting section forming a portion of said first vertical support post and adapted to vary the length of said first vertical support post.

12. The system as recited in claim 10 wherein said adjusting means comprises an extendable member forming a portion of said post support means and adapted to move said post receiving surface along the length of said sidewall supports.

13. The system as recited in claim 8 further comprising adjustable receiving means for engaging said post support means to said scaffolding.

14. A readily assemblable system for supporting scaffolding inside a boiler capable of use with a variety of different size boilers having different internal configuration shapes, wherein the boiler includes a converging pair of downwardly sloping lower boiler walls, said system comprising:

a generally horizontal founding truss for spanning between said lower boiler walls;

a pair of sidewall supports pivotally mounted on opposite ends of said founding truss for extending above and along said lower boiler sidewalls, and for supporting said scaffolding wherein said supports are adapted to conform to the lower sidewalls of a boiler;

a pair of support plates mounted at opposite ends of said founding truss for contacting said lower boiler sidewalls and for transferring forces from said scaffolding to said lower boiler sidewalls;

detachable post support means adapted for positioning at any of a plurality of locations along the length of said sidewalls supports, said support means adapted to engage a vertical support post; and means for varying the location at which said post support means engages said vertical post in relation to the length of said sidewall support.

15. The assembly of claim 14 wherein said founding truss further comprises a pair of means for pivotably mounting said support plates so that said plates conform to the slope of said lower boiler walls.

16. A readily assemblable system for supporting scaffolding inside a boiler capable of use with a variety of different size boilers having different internal configuration shapes, wherein the boiler includes a converging pair of downwardly sloping lower boiler walls, said system comprising:

a generally horizontal founding truss for spanning between said lower boiler walls;

a pair of sidewall supports mounted on opposite ends of said founding truss for extending above and along said lower boiler sidewalls, and for supporting said scaffolding; and a plurality of detachable post support brackets for mounting on said sidewall supports and for supporting said scaffolding, said post support brackets being adapted for positioning and engaging a vertical support post at any of a plurality of locations along the length of the sidewall supports.

17. The assembly of claim 16 wherein said brackets are adjustable to move along the length of said sidewall supports.

18. The assembly of claim 16 or 17 wherein said sidewall supports comprise ladders including pairs of elongated structural members crossed by spaced-apart rungs, and wherein said brackets removably mount on said rungs.

19. The assembly of claim 16 or 17 wherein said post supports further comprise extensible sections for selectively moving along the length of said sidewall ladders.

20. A founding ladder system comprising:

an elongated founding truss having first and second truss ends and upper and lower sides, first and second sidewall support plates transversely mounted near said first and second truss ends, respectively, and first and second pivotable mounting hinges mounted transverse to the length of said founding truss on said upper side near said first and second truss ends, respectively;

first and second sidewall support ladders each having a pair of parallel uprights connected by a plurality of spaced-apart rungs, said uprights being attached to said hinges so that said first and second ladders are pivotably mounted on said first and second truss ends, respectively;

a plurality of post support brackets for mounting on said sidewall ladders, each of said brackets having rung gripping hooks that may engage said rungs at any of a plurality of spaced apart locations along said ladders said post support brackets each having a post receiving surface adapted to engage a vertical support post that forms a portion of said scaffolding;

means for adjusting the position of said post receiving surface relative to said vertical support post to effect secure contact between said post receiving surface and said vertical support post; and a plurality of linking members connected to said vertical posts and extending therebetween.

21. A founding ladder system comprising:

an elongated founding truss having first and second truss ends and upper and lower sides, first and second sidewall support plates transversely mounted near said first and second truss ends, respectively, and first and second pivotable mounting hinges mounted transverse to the length of said founding truss on said upper side near said first and second truss ends, respectively, wherein each of said mounting hinges comprises a pivotable hinge member having an elongated hinge rod and having a pair of stub connectors projecting from said hinge rod intermediate the length thereof; and at least one strap retainer attached to said founding truss and encircling said hinge rod;

first and second sidewall support ladders each having a pair of parallel uprights connected by a plurality of spaced-apart rungs, said uprights being attached to said hinges so that said first and second ladders are pivotably mounted on said first and second truss ends, respectively; and a plurality of post support brackets for mounting on said sidewall ladders, each of said brackets having rung gripping hooks that may engage said rungs at any of a plurality of spaced apart locations along said ladders.

22. The system of claim 21 wherein said sidewall ladder uprights comprise hollow tubes sized to fit over said stub connectors.

23. The system of claim 22 wherein said sidewall ladder uprights further comprise a rod connector projecting from one end of each upright, wherein said rod connector is sized to fit inside said hollow tube upright.

24. The system of claim 21 wherein each of said brackets further comprise:

a post receiving channel;

at least one adjustable support connector extending between said channel and said hooks.

25. A founding ladder system comprising:

a founding truss having an elongated beam with first and second beam ends and upper and lower sides, further having first and second support plates mounted to slope upward from said lower side on said first and second beam ends, respectively, and further having first and second pivotable mounting hinges mounted on said upper side near said first and second beam ends, respectively, wherein each of said mounting hinges includes a pivotable hinge member having a pair of stub connectors projecting from an elongated hinge rod which is encircled and attached to said beam by at least a pair of strap retainers positioned between said stub connectors;

first and second founding supports, each of which consists of a ladder having a pair of tubular uprights connected by a plurality of spaced-apart rungs, said uprights having a hollow internal construction sized to fit over and mount on said stub retainers; and a plurality of founding brackets, each of which includes hooks sized to clip over and mount on said rungs, a pair of parallel, elongatable struts extending from said hooks to a trough which is mounted transversely across said struts.

26. A founding ladder system for supporting scaffolding inside a structure having converging walls, said system comprising:

means for spanning between said converging walls;

means for supporting said scaffolding along said converging walls so that a major part of the forces from said scaffolding are transferred through said means for spanning to said converging walls said supporting means being positioned wholly within said converging walls and held in place against said converging walls only by the weight of the scaffolding and adjustable scaffolding receiving means connected to said supporting means receiving said scaffolding so that the position of said scaffolding is accommodated.

27. The founding ladder system of claim 26 wherein said means for spanning and said means for supporting cooperate together to accommodate the angle of said converging walls.

28. An apparatus for permitting workmen access to the interior surfaces of a boiler having converging bottom walls, comprising:

a scaffold;

means for supporting said scaffold exclusively by resting upon said converging bottom walls without attachment thereto; and adjustable scaffolding receiving means connected to said supporting means for effecting firm contact between said scaffolding and said supporting means so that the position of said scaffolding is accommodated.

29. An apparatus for permitting workmen access to the interior surfaces of a boiler as described in claim 28, wherein the means for supporting said scaffold comprises a structural member connected to said scaffold and spanning the converging bottom walls, said structural member wedged by the weight of the scaffold between the converging walls, said wedging generating strong frictional forces between the structural member and the walls to stabilize and support the scaffold.

30. A readily assemblable system for supporting scaffolding inside a chamber capable of use with a variety of different sized chambers having a pair of downwardly sloping lower walls, wherein said system comprises:

a plurality of horizontal founding trusses for spanning between said lower walls;

a pair of sidewall supports mounted on opposite ends of each of said founding trusses, extending upwardly from said trusses along said lower walls, said sidewall supports contacting said walls and transferring a portion of the weight of said scaffolding to said walls;

a plurality of detachable post support means connected to each of said sidewall supports and adapted for positioning at any of a plurality of locations along the length of said sidewall supports, said post support means having a post receiving surface adapted to engage a first vertical support post, said first vertical support post being interconnectable with additional vertical support posts;

means for adjusting the position of said post receiving surface relative to said first vertical support post to effect secure contact between said post receiving surface and said first vertical support post;

horizontal linking members connected to said vertical support posts and disposed in the same horizontal planes as said horizontal founding trusses; and transverse linking members connected to said vertical support posts and disposed transverse to the horizontal planes of said horizontal founding trusses.

31. The system as recited in claim 30 wherein said adjusting means comprises a length adjusting section forming a portion of said first vertical support post and adapted to vary the length of said first vertical support post.

32. The system as recited in claim 30 wherein said adjusting means comprises an extensible member forming a portion of said post support means and adapted to move said post receiving surface along the length of said sidewall supports.

* * * * *